United States Patent [19]

Blackwell, III

[11] Patent Number: 4,998,735

[45] Date of Patent: Mar. 12, 1991

[54] BOARD GAME

[75] Inventor: George L. Blackwell, III, Pine Bluff, Ark.

[73] Assignee: MindGames, Inc., Pine Bluff, Ark.

[21] Appl. No.: 455,974

[22] Filed: Dec. 18, 1989

[51] Int. Cl.[5] ..... A63F 3/00; A63F 9/18

[52] U.S. Cl. ..... 273/249; 273/308

[58] Field of Search ..... 273/249, 248, 243, 308

[56] References Cited

U.S. PATENT DOCUMENTS

| | | | |
|---|---|---|---|
| 678,791 | 7/1901 | Ford | 273/296 |
| 999,913 | 8/1911 | Todd | 273/300 |
| 1,138,534 | 5/1915 | Brister | 273/308 |
| 4,004,810 | 1/1977 | Henrie | 273/249 |
| 4,029,320 | 6/1977 | Hausman | 273/249 |
| 4,090,717 | 5/1978 | Rossetti | 273/249 |
| 4,109,918 | 9/1978 | Mele et al. | 273/256 |
| 4,449,710 | 5/1984 | Davis | 273/249 |
| 4,557,485 | 12/1985 | Lardon | 273/249 |
| 4,593,910 | 6/1986 | Font | 273/273 |
| 4,607,848 | 8/1986 | Maguire et al. | 273/269 |
| 4,732,393 | 3/1988 | Rita | 273/269 |

FOREIGN PATENT DOCUMENTS

| | | | |
|---|---|---|---|
| 2187968 | 9/1987 | United Kingdom | 273/242 |

*Primary Examiner*—Benjamin Layno

*Attorney, Agent, or Firm*—Stephen D. Carver

[57] ABSTRACT

A game for two or more players who compete to guess correct answers in response to the reading of statements provided on associated clue cards. The speed at which a correct answer is provided is related by the rules to the speed of playing piece movement over an associated game board. The clue cards include a correct "answer" sought in response to reading of the individual statements written on the card. The game board is geometrically divided into a playing space for each player. Each playing space is divided into a multi-spaced path to be traveled by the playing pieces, which travel toward a winner's circle defined at the center of the board. Piece movement is generally related to successful answering of the clue card questions. The statements on each clue card all relate to a particular category, such as a person, place, thing or event. Each statement in effect provides a "clue" to the player as to what "answer" is desired. These statements vary in relative suggestiveness between total vagueness and specificity. In general, according to the rules, piece movement is correlated to successful answering. The fewer statements which must be read from the clue card to the player before he correctly discerns the correct answer, the more "points" he will generate to move his piece upon the board towards the winner's circle. An element of randomness is provided by associated venture cards.

1 Claim, 3 Drawing Sheets

BOARD GAME

BACKGROUND OF THE INVENTION

The present invention relates generally to multi-player board games. More particularly, the present invention relates to a multi-player board game of the type comprising a plurality of "question" cards which must be correctly answered to generate movement points for the players.

As will be recognized by those skilled in this art, a wide variety of board games previously exist. For example, of some relevance to the present invention are the educational board games disclosed by Rossetti, U.S. Pat. No. 4,090,717 issued May 23, 1978; by Mele et. al., U.S. Pat. No. 4,109,918, issued Aug. 29, 1978; and by Font, U.S. Pat. No. 4,593,910, issued June 10, 1986. Each of the games disclosed in the aforementioned prior art patents employs a plurality of cards which present questions or information adapted to elicit a preselected response from the players, and some form of game board for marking player progress. In each of the above-referenced games, the player's movement on the game board is determined by the player's ability to correctly answer the question or clues on the playing card.

Board games disclosed by Todd, U.S. Pat. No. 999,913, issued Aug. 8, 1911; by Maguire et. al., U.S. Pat. No. 4,607,848, issued Aug. 26, 1986; and by Rita, U.S. Pat. No. 4,732,393, issued Mar. 22, 1988, also employ playing cards which provide information to suggest the correct answer. However, these games provide a separate player board or score card for noting player progress. In some games, such as that of the Todd reference, cards are arranged in a manner that makes them difficult for the players to use. For example, all cards in a given series are related to the same general subject and are dependent upon one another. The correct "answer" and score value for one question card is displayed on a different card, which must be located before the player may be awarded game points. Moreover, there is only one question per card, so that the player is only afforded a single chance to guess the correct answer. Additionally, the question or statement is directed to only one player who must attempt to answer, and the other players are not given the opportunity to respond.

Various educational card games also have been proposed in the prior art. For example, U.S. Pat. No. 678,791, issued to Ford on July 16, 1901, illustrates game cards which include both a pictorial and a written, narrative description of the subject matter. The card includes various questions adapted to suggest the subject matter of the card. During play, each player holds a plurality of question cards. Certain difficulties are encountered during play, since various questions are independent of each other, and may be read in numerical order only, although each is equally suggestive of the answer. The answer appears on the side opposite the questions, and the same card may be viewed by different players during the game. Moreover, the game is limited to include only subjects which may be graphically depicted. Only one player is selected to answer a particular question.

A similar card game is proposed by Brister, U.S. Pat. No. 1,138,534, issued May 4, 1915. Described therein are two-part playing cards which are separated before play. One half of the card presents a list of several multiple choices to be matched by the players to the opposite half which presents the correct answer. The players see the answer choices before a question is asked, and must merely select the correct of the available answers. Suggestions and answers may be in question, narrative, descriptive, or pictorial form. The participation of a "lecturer" who is not entitled to score to win the game is also required. One player is selected to offer an answer, and other players are not permitted to volunteer a response. No board or other game apparatus is used for marking player progress.

While other such games employ various forms of clues, no board game of which I am aware provides a plurality of intellectually-based statements, in the form of "clue" cards, which when correctly answered generate piece movements in the manner I disclose. All of the aforementioned games are essentially educational in purpose, and are thus typically narrowly limited in the scope of the subject matter presented. The prior art does not provide games having clues of sequentially varying difficulty. None of the prior art games known to me generates different score values for different clues related to a single correct answer. Moreover, none of the aforementioned prior art games addresses both the player's knowledge and board strategy skills. The playing rules of the prior art game appear too rigid to permit constructive interplay or enjoyable competition between game players.

Hence it is desired to provide an entertaining and challenging game which may be enjoyed by any number of players of varying levels of skill.

SUMMARY OF THE INVENTION

The present invention comprises a unique board game for two or more players in which unique card-borne statements provide clues to the players from which a desired correct answer may be discerned. According to the rules, the speed at which a correct answer is provided is related to the speed of playing piece movement over the associated game board. A plurality of unique clue cards are associated with the playing board, and players must substantially guess or anticipate the correct "answer" in response to reading of the individual statements written on the card.

In the best mode the game board defines a preferably octagonal playing space divided into eight playing areas, one for each player. Each playing space is divided into a multi-spaced path to be traveled by the playing piece. Each player moves his piece between a marked starting position and through the path, hopefully ending in a winners circle position defined at the center of the board. Piece movement is generally related to successful answering of the clue card questions.

The plurality of clue cards are neatly disposed within a container and accessible by the players. Each clue card is printed with a plurality of statements. The statements on each side of each clue card all relate to a subject within a particular category. The categories relate to persons, places, things or events. A correct answer to a group of preferably six statements is visibly displayed at the bottom of the clue card. Each statement in effect provides a "clue" to the player as to what "answer" is desired. These statements vary in "strength" between total vagueness and specificity. In other words, some of the clues will be so vague as to merely give a remote hint as to what answer is requested. Other clue statements narrow the inquiry so that a finite list of possible answers are indicated, but do not positively identify the answer. Still other statements are so suggestive that the intended answer will be readily apparent after the statement is read.

In general, according to the rules, piece movement is correlated to successful answering. The fewer statements which must be read from the clue card to the player before he correctly discerns the intended answer, the more "points" he will generate. Piece movement is correlated with point acquisition. A player thus moves his piece over the board towards the winning position based upon the "quickness" of his correct answer. In the best mode, for example, there are six statements within a particular category which allude to a desired answer. If a player answers the question correctly immediately after the reading of the first statement or clue, he is awarded six points and his piece moves six spaces on the board. If the player has successfully answered after hearing all six statements, he is awarded only one point and his piece may be moved only one space.

However, each playing area is preferably divided into two primary zones, the first being a "free guess" zone and the second being a "penalty" zone. In the free guess zone, a player may offer two candidate answers to each clue being read by the reader without penalty. He must then move back one space for each additional incorrect answer. However, when that player's piece moves to the penalty zone, he is penalized one space for each incorrect answer he submits to a clue.

In addition to the above described non-random piece movement, an element of randomness is provided. In particular, a plurality of venture cards are included in the game. Each venture card essentially randomly directs the drawing player. Venture cards are drawn when the player lands on a space provided with a venture marking. A limited number of venture markings are disposed within each playing area, and when a piece lands on a venture marking, a venture card must be drawn and read. A typical venture card may require the drawing player to move forward or backwards two to four spaces. Alternatively, a venture card may allow a drawing player to require an opponent to move back preselected spaces.

Because of this element luck is introduced into the otherwise intellectually oriented aspects of the game, younger and less experienced players may often gain an advantage and enjoy competing with older or more experienced players.

Thus a broad object of the present invention is to provide an intellectually oriented board game for participation by two or more players.

Another object of the present invention is to provide a board game of the character described in which statements varying in suggestiveness between vagueness and specificity are read to the players in an effort to prompt them into providing a correct answer.

Yet another object of the present invention is to provide an intellectually satisfying board game of the character described which may be played concurrently by two or more players having varying degrees of skill.

A still further object of the present invention is to provide a board game of the character described which incorporates intellectually stimulating clue statements, including puns and plays on words.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
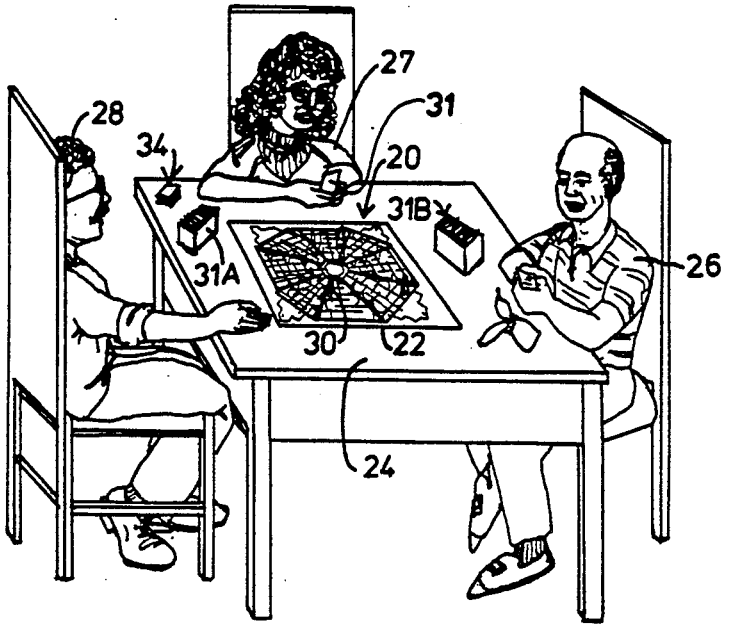
FIG. 1 is pictorial view illustrating the game in use by a plurality of typical players.
Figure 2:
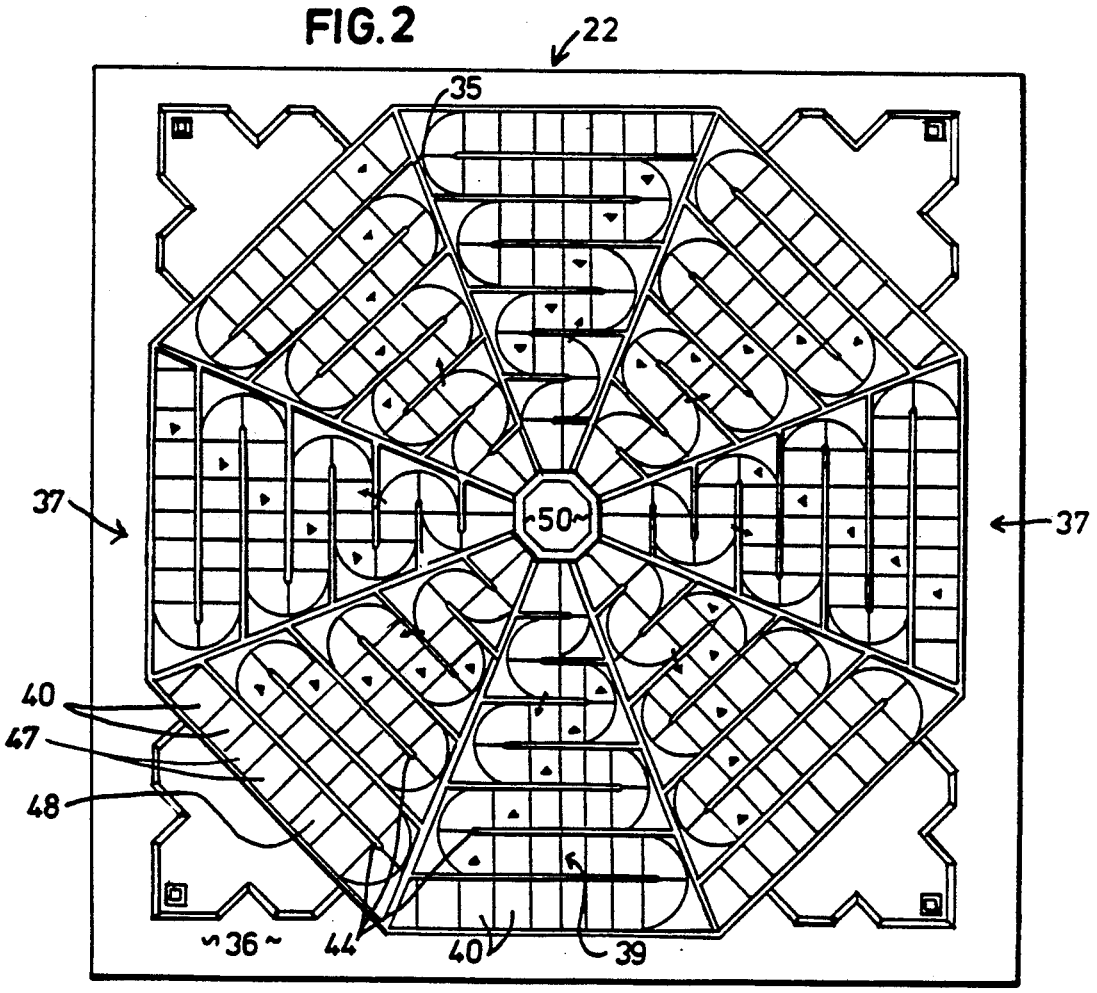
FIG. 2 is an enlarged scale, top plan view illustrating the preferred game board.
Figure 9:
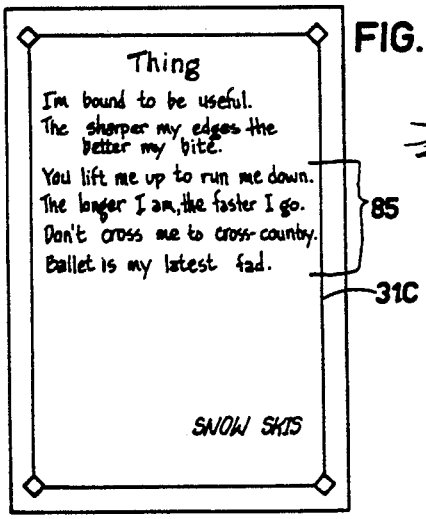
FIG. 9 is a rear plan view showing a clue card in the "thing" category.
Figure 10:
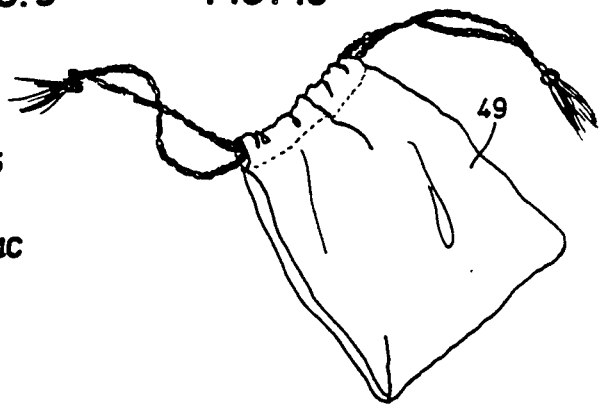
FIG. 10 is a perspective view of the preferred player piece container.

With initial reference now directed to FIG. 1 and 2 of the appended drawings, reference numeral 20 generally indicates a board game constructed in accordance with the teachings of the present invention. Game 20 comprises a playing board broadly designated by the reference numeral 22 which may be unfolded and placed upon a table 24 or any other suitable flat surface. The game is designed for a plurality of players, preferably two to eight, such as players 26 through 28 seated about table 24. A number of similarly configured playing pieces 30 are packaged within a convenient bag 49 (FIG. 10). Each player has a playing piece 30 (FIGS. 1, 11) which may be moved through the playing area generally defined on the board 22 to be hereinafter described. In addition, a plurality of clue cards, such as those generally designated by the reference numerals 31, 31A, 31B, and 31C (FIGS. 6–9) are conveniently disposed upon the table top 24 for access by all of the players.

As will be described in more detail hereinafter, certain desired answers which are listed on the clue cards are to be ascertained by the players in response to the reading of various clues. The clues are actually in the form of statements listed on the clue cards, starting with the vaguest, least suggestive clue and finishing with the most specific. Movement of the game pieces 30 upon the board is generally dictated by the player's response to the statements on the clue cards and by instructions on the venture cards 34.

Figure 12:
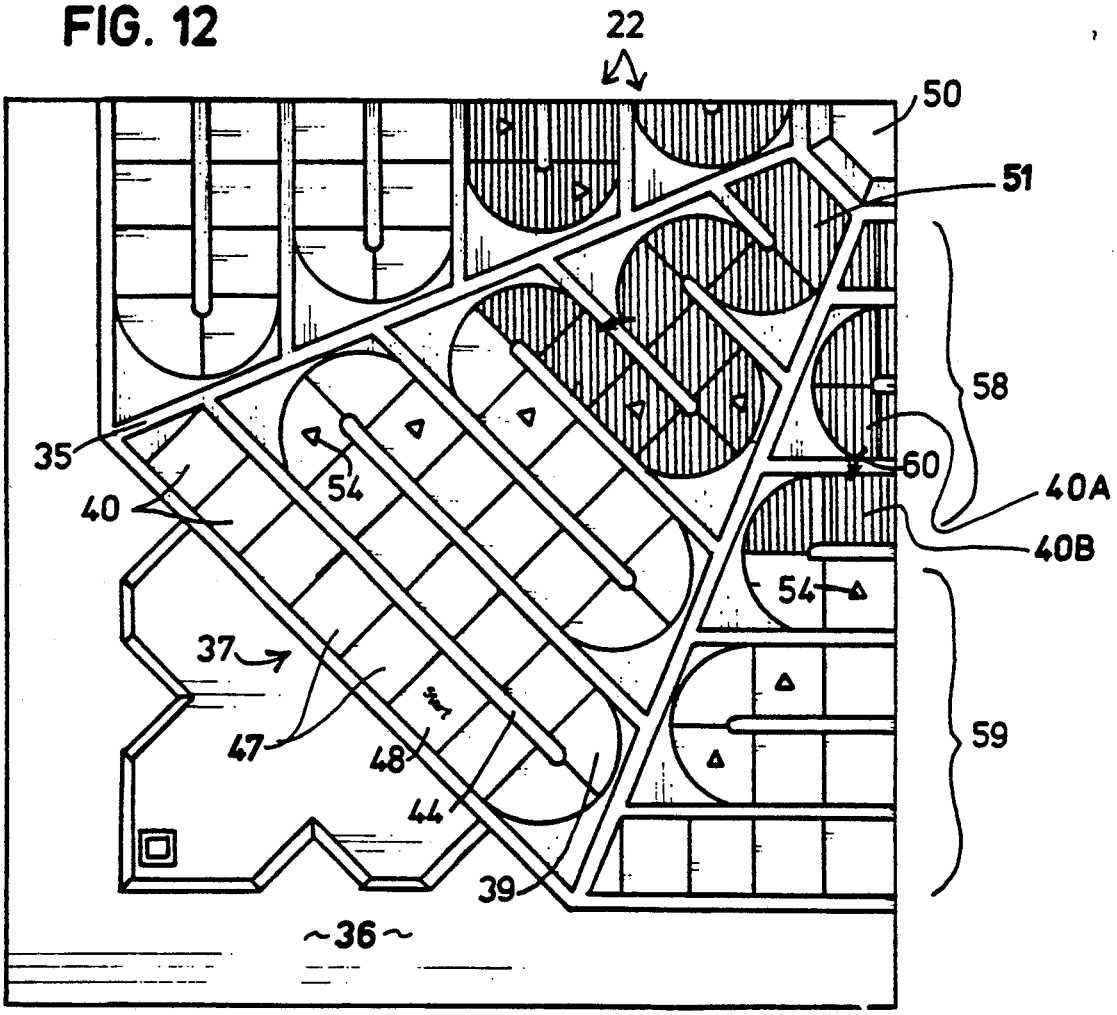
FIG. 12 is an enlarged, fragmentary top plan view of a portion of the playing board showing the "free" guess zone, the "penalty" zone, and a plurality of typical "venture" markings.

With primary reference now directed to FIGS. 2 and 12, the game board 22 is adapted to be unfolded and disposed upon a supporting planar surface such as table top 24. The game board 22 defines a playing surface generally designated by the reference numeral 36 which has been divided into a plurality of geometrically adjoining, radially spaced apart playing areas, generally designated by the reference numeral 37. Playing areas 37 are each generally triangular, and while it will be noted that the overall configuration seen in FIG. 2 is thus octagonal, the board could be modified to provide for more or less than eight players. Each of the playing areas 37 is separated from its neighbor by radially outwardly extending borders 35. Each playing area 37 comprises a generally serpentine playing path 39 comprised of a plurality of individual spaces 40 which wind upwardly between the outermost borders 35 between parallel border markings 44. Path 39, for example, extends from positions 47 past starting position 48 to a position 51. Position 51 is immediately adjacent the winning position at the center of the board comprising a winner's circle 50. Positions 47 are actually "behind" the starting position 48, in case the player is penalized and must move backwards.

Figure 11:
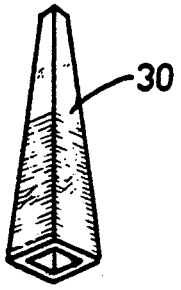
FIGURE 11 is an isometric view of a preferred playing piece.

As seen in FIG. 11, playing piece 30 is generally in the form of a pyramid, and it is adapted to be snugly received upon individual spaces 40 and thereafter moved along path 39 upon the individual spaces around the border markings 44 until a player successfully enters the winner's circle 50.

With primary attention directed now to FIG. 12, it will be noted that a plurality of regularly spaced-apart venture markings 54 of generally triangular shape are defined at regular intervals along the path 39. When a player's piece lands upon a space with such venture marking, the player must draw a venture card and follow its instructions as will be hereinafter described.

The playing areas 37 are divided into two primary zones. The reference numeral 58 broadly designates the zone defined by the interior spaces, which are preferably colored red to indicate a "penalty" zone. Those lower spaces at the bottom half of playing area 37 which are colored non-red have been generally designated by the reference numeral 59 (FIG. 12). As will be explained hereinafter, how a playing piece is moved depends in part on whether the player's piece is located in zone 58 or zone 59. An arrow 60 drawn on the interior zone 58, causes a random backward movement from space 40A to space 40B if the player happens to land on space 40A.

Figure 3:
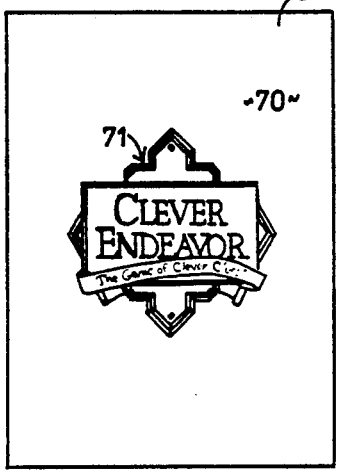
FIG. 3 is a front plan view of a typical venture card.
Figure 4:
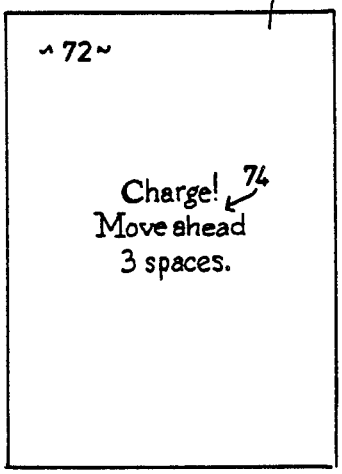
FIG. 4 is a rear plan view of a venture card, showing one of a number of possible piece movements assessed to players by the various venture cards.
Figure 5:
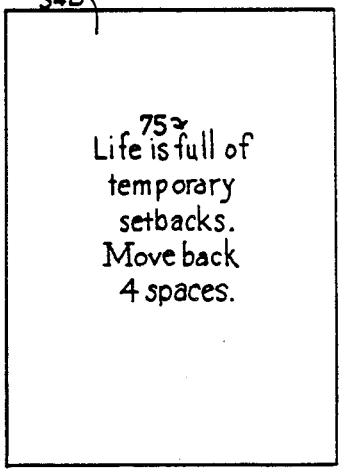
FIG. 5 is a rear plan view of another venture card illustrating a penalty of the type assessed to players by various venture cards.

With reference directed now to FIGS. 3 through 5, a typical venture card 34 of generally rectangular proportions includes standard background printing on the face 70 including a stylized trademark 71. The opposite face 72 (FIG. 4) of a typical venture card 34 contains the instructions 74 to move forward three spaces. On the other hand, venture card 34B (FIG. 5) contains instructions 75 requiring the player to move backwards four spaces. Accordingly, the player will move his game piece 30 (FIG. 11) the designated number of spaces 40 within his playing area 37. Alternative venture cards give the drawing player the opportunity to move a selected opponent backwards a stated number of spaces. A player can be moved backwards or forwards even before he has had a turn.

With reference now to FIGS. 6 through 9, typical clue cards are illustrated. Each is marked with a "category" on its top, and each contains a plurality of statements comprising "clues." Each bears a desired "answer" at its bottom. During play, a participant will read a clue card to the other players. As shown in FIG. 1 a player 27 is reading a clue card to players 26, 28, who must discern the answer.

Figure 6:
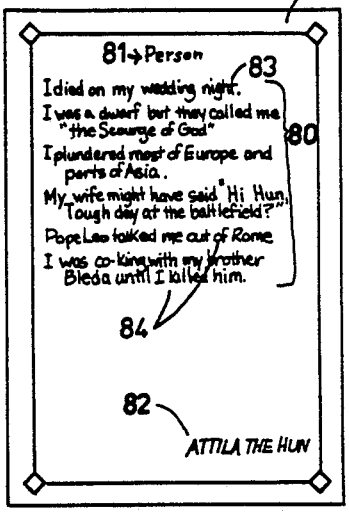
FIG. 6 is a rear plan view showing a typical clue card, illustrating statements falling in the "person" category.
Figure 7:
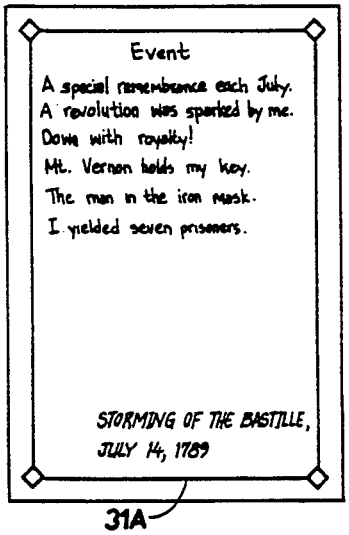
FIG. 7 is a rear plan view showing a clue card having statements in the "event" category.
Figure 8:
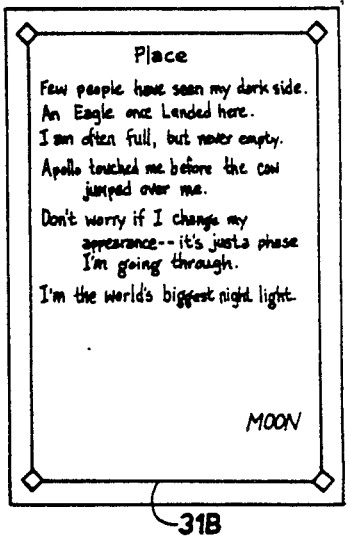
FIG. 8 is a rear plan view showing a clue card in the "place" category.

Referring again to FIG. 6, one type of clue card displays a plurality of suggestive statements which have been generally designated by the reference numeral 80. In the best mode, six individual statements are recited. A category 81 may be listed above clue statements 80. The category 81 named on card 31 shown in FIG. 6 is "person." However, the statements on the other clue cards 31A–31C relate to other categories such as "events" (FIG. 7), "places" (FIG. 8), or "things" as seen in FIG. 9. Other cards (not shown) may simply be in a "mystery category," and they are thus "harder" since the players do not know the category relating to that card's clues. Except for the mystery Answers relating to a subject which cannot be readily categorized as a "person," "place," or "event" are normally designated as a "thing." For example, animals would appear in the "thing" category.

With reference again to FIG. 6, clue statements 80 relate to a particular historical personage, Atilla the Hun. The name of the person identified appears as the correct "answer" 82 in clear print at the bottom of the card, where it will not be confused with the previously listed clue statements. In the best mode, the first clue statement 83 is very vague, making it difficult for a player to guess the correct answer. Each of the subsequent clue statements 84 is somewhat more specific than the statement preceding it. Thus, as a player reads the statements 80 from the clue card 31, it will be apparent that certain statements are "better" than others for clueing the player to the correct answer. After hearing all the clue statements 80, the player should be able to discern the correct answer quite readily. Where the answer 82 refers to an event or place, as in FIGS. 7 and 8, each of the clue statements may be quite specific. On the other hand, where the card relates to a "thing," as in FIG. 9, the clue statements 85 may be much more vague or general.

Various techniques may be employed for enhancing the challenge of the game as described below. For example, the players may be permitted to substitute obviously false statements for one or more of the printed clue statements. The game may also be expanded by the subsequent addition of new clue cards containing clue statements created and submitted by game players.

INSTRUCTIONS FOR PLAY

From two to eight players may individually play this game. If more than eight people wish to play, teams may be formed. The object is to be the first player to move one's game piece from Start 48 to the Winner's Circle 50 by solving the clues as they are read aloud. Each clue card presents six statements which as a whole describe a Person, Place, Thing, Event, or Mystery subject.

The triangular playing area 37 for each player consists of one-eighth of the octagon, and is divided into two zones, red and non-red. For each reading of a six-statement clue, each player whose game piece is in the non-red zone may offer two answers to the clue without penalty. After the first two incorrect guesses by a player within the reading of one clue the player must move back one space for each additional incorrect guess. Once a player enters the red zone, he or she must always move back one space for each incorrect guess offered by the player. No free guesses are allowed.

For each clue a player solves, the player may move his or her game piece forward according to the following arrangement: seven minus the number of statements read or partially read by the time the clue is solved. Therefore, a correct guess will move the player ahead between one and six spaces. For example, if two clue statements have been read, the player moves ahead five spaces. If all six statements have been read, the player moves ahead one space. For an answer to be correct, it must specifically identify the answer, but need not be the exact words of the written answer.

To start the game, the youngest player present is designated as the Clue Reader and begins by drawing a clue card from the front of the clue deck. The Clue Reader first reads aloud the category (i.e., "place"), then reads aloud the statements one at a time. The Clue Reader should pause momentarily between each statement, allowing for players to offer answers if they desire. After the fourth statement is read, the Clue Reader may quickly repeat the previously read statements. Information in parenthesis is "For Your Information" only, and should not be read aloud until the clue is finished.

After the clue is finished, it is placed at the rear of the deck. The player who correctly answers the clue becomes the next Clue Reader. If the clue is not solved, then the player to the right of the Clue Reader becomes the Clue Reader for the next clue. If two or more players offer a correct answer at exactly the same time, the clue is passed, and the same Clue Reader reads the next clue.

The six clue statements may be read in any order. Since it is to the advantage of other players to solve a clue as early in the reading as possible, the Clue Reader should attempt to read the vaguest statements first. The Clue Reader has about fifteen seconds from the time he or she receives the clue box to read the first statement of his or her choice. In general, but not always, the first several statements listed on a clue card are vaguer than the latter statements.

The Venture cards should be stacked face down somewhere accessible to all players. After a player moves, if the player finds his or her game piece on a space marked with a triangle, the player must draw a card from the Venture deck and follow the instructions accordingly. Set used Venture cards on the bottom of the deck. Players must allow time for a Venture card to be read and followed, even if a player moves backward onto a triangle during the reading of a clue.

If a player lands on the red space with an arrow pointing to another red space, the player must move back to the space indicated.

A player may enter the Winner's Circle with more than the exact number of advances required. Any player in the Winner's Circle at the beginning of a clue being read may win the game by being the first to answer the clue after the Clue Reader begins reading the third statement. Of course, any player not in the Winner's Circle may correctly guess the answer beforehand. If a player in the Winner's Circle guesses incorrectly or prematurely, the player must move back to the red space adjoining the Winner's Circle.

Players may selectively increase the skill level and make the challenge of the game more difficult in the any of the following ways. The players may agree to reduce the number of statements read from six to four, or any other number players choose. The Clue Reader may select which statements to read. The players may agree to make the game more challenging by never revealing the subject category. Or the Clue Reader may be allowed to create an obviously false statement and pass it off as real. The Clue Reader may substitute his own false statement for one of the six given statements at any time.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

WHAT IS CLAIMED IS:

1. A board game for two or more players, said game comprising:

a game piece for each player;

a plurality of clue cards to be utilized by the players to play the game, each clue card comprising:

a category comprising a person, place, thing, or event;

a correct and desired answer for the players to discern, each answer classified within said category; and, a plurality of clue statements to be sequentially read to the players by a player designated as a card reader for suggesting said correct and desired answer to said players, said statements arranged in order by difficulty on said cards, so that the first-listed statement provides the least amount of specific information from which said correct and desired answer may be discerned, and the latter-listed statements provide increasingly more specific information for indicating said correct and desired answer;

a plurality of venture cards for randomly affecting the movement of said game pieces;

a game board adapted to be disposed upon a supporting surface for receiving said game pieces, said clue cards, and said venture cards, said game board comprising:

a plurality of adjacent, generally radially spaced apart playing areas, one for each player, wherein each of said player's game pieces moves within one of said plurality of playing areas;

distinctive border means for separating said playing areas from one another so that said game pieces do not advance into adjacent playing areas; and, a winning position defined in the center of said game board, said winning position bordering each of said playing areas;

wherein each of said plurality of playing areas comprises:

a starting position;

a multi-space, serpentine path to be traveled by said players' game piece and interconnecting said starting position with said winning position;

a plurality of venture markings defined within said path for indicating to a player whose piece lands on one of said venture markings that one of said plurality of venture cards must be played;

randomly dispersed means for requiring that a player's game piece be moved backwards;

means on said path for defining a free guess zone said free guess zone occupying the plurality of spaces extending roughly halfway between said starting position and said winning position for indicating to a player whose piece is within that zone that he may offer two incorrect answers to each statement read to him from said clue cards before being penalized for each additional incorrect answer;

means on said path for defining penalty zone said penalty zone occupying the remaining plurality of spaces extending between said free guess zone and said winning position for indicating to a player whose piece lands on said penalty zone that after one incorrect response to a statement read to him from said clue cards he must move his piece backwards one space, whereby advancement on said game board is made more difficult as a player nears said winning position; and, rule means for determining game piece movement such that each player may move his piece a predetermined number of spaces established by said rule means for each correct and desired answer discerned by said player in response to the reading of said clue statements, and wherein the reading of each additional clue statement results in the reduction of the number of spaces to be advanced by said player's game piece.

* * * * *